US006092892A

United States Patent [19]

Taniguro et al.

[11] Patent Number: 6,092,892

[45] **Date of Patent: *Jul. 25, 2000**

[54] INK JET RECORDING APPARATUS

[75] Inventors: Masahiro Taniguro, Ushiku; Tetsuo Suzuki; Hiroyuki Saito, both of Yokohama; Koichi Tanno, Kawasaki; Haruyuki Yanagi, Machida; Makoto Kawarama, Ayase; Hiroyuki Kinoshita, Kawasaki; Masaya Shinmachi, Kawasaki; Tan At Ming, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/416,096

[22] Filed: Apr. 4, 1995

[30] Foreign Application Priority Data

Apr. 5, 1994 [JP] Japan ..... 6-066987
Mar. 31, 1995 [JP] Japan ..... 7-074749

[51] Int. Cl.[7] ..... B41J 2/01

[52] U.S. Cl. ..... 347/104; 400/43; 400/48; 400/595; 400/642

[58] Field of Search ..... 347/8, 104, 37, 347/43; 346/134; 400/55, 56, 58, 613.3, 632, 642, 648, 23, 43, 48, 578, 586, 595

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,463,359 | 7/1984 | Ayata et al. | 347/56 |
| 4,723,129 | 2/1988 | Endo et al. | 347/56 |
| 4,740,796 | 4/1988 | Endo et al. | 347/56 |
| 4,992,805 | 2/1991 | Yoshizawa et al. | 347/104 |
| 5,245,364 | 9/1993 | Uchida et al. | 347/104 |
| 5,291,224 | 3/1994 | Asano et al. | 346/134 |
| 5,366,301 | 11/1994 | Martin et al. | 400/56 |

FOREIGN PATENT DOCUMENTS

| | | |
|---|---|---|
| 0381197 | 8/1990 | European Pat. Off. . |
| 0581276 | 2/1994 | European Pat. Off. . |
| 61-280965 | 12/1986 | Japan . |
| 3-027949 | 2/1991 | Japan . |
| 4332652 | 11/1992 | Japan . |
| 5177835 | 7/1993 | Japan . |

*Primary Examiner*—John Barlow
*Assistant Examiner*—Craig A. Hallacher
*Attorney, Agent, or Firm*—Fitzpatrick, Cella, Harper & Scinto

[57] ABSTRACT

An ink jet recording apparatus having an image recording area for performing image recording onto a recording medium includes a head holding portion for holding an ink jet recording head, a platen, and a recording medium exhausting device. The platen has planar and facial sections. The planar section supports the recording medium opposed to the ink discharge ports in the image recording area. The facial section is disposed downstream of the image recording area with respect to a conveyance direction of the recording medium, and extends in a direction away from the ink discharge ports toward the conveyance direction. The planar section and the facial section are continuous, and the angle between the extension of the planar section and the facial section is from 3.7 to 7.5 degrees. The recording medium exhausting device, disposed downstream of the facial section of the platen in the conveyance direction, exhausts the recording medium from the recording area by guiding the recording medium from the extension of the planar section of the platen in a direction closer to the facial section of the platen.

49 Claims, 11 Drawing Sheets

INK JET RECORDING APPARATUS

BACKGROUND OF THE INVENTION

1. Field of the Invention

The present invention relates to an ink jet recording apparatus for discharging ink droplets onto the recording medium to obtain a desired ink image.

2. Related Background Art

Conventionally, recording apparatuses which have features of printer, copying machine and facsimile, or are employed as the output device for composite electronic equipment or workstation containing a computer, a work processor and so on, are configured to record the image (including characters or symbols) onto the recording sheet (recording medium) such as a paper or a plastic thin plate, based on image information. Such recording apparatuses can be classified into an ink jet system, a wire dot system, a thermal system, and a laser beam system, depending on the recording method.

In a serial type recording apparatus of the serial scan system of scanning in a direction crosswise to the conveying direction of recording sheet (sub-scan direction), the recording can be performed on the whole recording sheet by repeatedly performing the operation of recording (scanning) the image by recording means mounted on a carriage moving along the recording sheet, after recording one line, feeding (pitch conveying) the sheet by a predetermined amount, and then recording (scanning) the image at the next line on the recording sheet which is stopped again.

On the other hand, in a line type recording apparatus which performs the recording only by the sub-scanning (conveying) of the recording sheet in a conveying direction, the recording is performed on the whole recording sheet by repeatedly performing the operation of, after setting the recording sheet at a predetermined recording position, recording one line collectively feeding (pitch conveying) the sheet by a predetermined amount, and further recording the next line collectively.

Among the above recording apparatuses, a recording apparatus of the ink jet system (ink jet recording apparatus) performs the recording by discharging the ink from recording means (recording head) onto the recording sheet. The ink jet recording apparatus has the advantages in which recording means can be made compact, the higher definition image can be recorded at higher speed, the ordinary paper is usable for recording without needs of any special treatment, the running cost is lower, there is less noise owing to the non-impact method, and the color image is readily recorded by using multi-color inks.

In the ink jet recording apparatus, the recording medium supplied by a sheet feeder has its conveyance surface held by a planar platen in the image recording area, and after the image is formed by the recording head, it is exhausted by paper exhausting means provided downstream in the conveyance direction.

In the conventional ink jet recording apparatuses, there was typically provided a certain gap between the recording head and the recording medium. Therefore, there were some problems as follows:

(1) If there is too wide gap between the recording head and the recording medium, the impinging accuracy of ink droplets may degrade, resulting in poor recording quality.

(2) If there is too narrow gap between the recording head and the recording medium, the gap between the recording head and the recording medium is removed due to deformation of the recording medium, causing sliding with each other, which causes the output image to be not only contaminated but also the recording head or recording apparatus main unit to be out of order due to nozzle clogging with the paper powder or dust which has entered the nozzle.

(3) Further, with the spread of color printers in recent years, there are increasingly many instances for recording the image having a great amount of ink impingement. In these instances, a wavelike undulation (thereinafter referred to as waving) may arise on the recorded face because the recording medium has swollen with the ink sinking into the recording medium. In such instances, the distance for ink droplets to reach the recording medium may vary, thereby causing the impinging position to be offset, resulting in uneven recording and poor image quality.

(4) Also, owing to the increased recording speed and the multicolor recording, the recording head is provided with a longer nozzle array, requiring an elongated interval of carrying the recording medium between the rollers disposed before and after the recording head in the conveyance direction of the recording medium, which further fosters the problem (3).

(5) With such longer nozzle array of the recording head, it is necessary that if the trailing end of the recording medium gets rid of conveying means in forming the image up to the trailing end of the recording medium, the recording sheet is conveyed with a conveying force of paper exhausting means to accomplish the recording. At this time, if the trailing end of recording medium is deformed, or floated, the recording sheet may, in some cases, contact with or slide on the recording head.

As shown in FIGS. 5 and 6, in the conventional constitution having a platen and exhausting means, if the recording medium waved, that waving portion would significantly float directly up the platen surface, so that the distance L0 between the set record surface and the ink jet recording head would greatly vary.

In this case, the variations in the impingement accuracy of discharged ink may not only occur due to partial differences in the distance between the recording head and the recording medium, but also the ink discharge timing in each nozzle is not normally identical, so that the varying ink droplet flight distance causes the impinging position to be offset, making high quality image recording even impossible.

Further, if the waving is large such as L1>L0, the recording head and the record face of recording medium may slide, as above described, thereby contaminating the output image, and causing damage to the recording head or recording apparatus main unit. To avoid the above drawback, the L0 value is taken to be as large as possible to relieve the abuses of waving, and eradicate the sliding between the recording head and the recording medium, but the recording accuracy and quality may significantly degrade, and it is possibly undesirable to obtain excellent results of image recording.

Also, even in the cases where there is no waving, particularly the end portion of recording medium may be raised up because the recording medium itself is stored in unfavorable condition. In recording the image on such recording medium, it often became difficult to record on the end portion of recording medium owing to the above reason, and was obliged to take a narrower image recording area reluctantly.

Further, to suppress the waving of the recording medium due to ink droplets as above described, there has been conventionally known an ink jet recording apparatus (Japanese Laid-open Patent Application No. 61-280965) for placing the recording medium into contact with the platen by generating a negative pressure, and an ink jet recording apparatus (Japanese Laid-open Patent Application No. 3-27949) for placing the recording medium into contact with the conveying belt by generating an electrostatic force. However, either of these recording apparatuses requires a device for generating negative pressure or static electricity, giving rise to complex constitution, larger size, and increased manufacturing costs of the recording apparatus.

SUMMARY OF THE INVENTION

In the light of the aforementioned problems, an object of the present invention is to provide an ink jet recording apparatus having high image recording quality by retaining a suitable interval between an ink jet recording head and a recording medium.

It is another object of the present invention to provide an ink jet recording apparatus having high image recording quality by suppressing the waving of the recording medium due to ink droplets.

It is another object of the present invention to provide an ink jet recording apparatus having high image recording quality by retaining a suitable interval between an ink jet recording head and a recording medium in performing the image recording using an ink jet recording head provided with a long discharge port array along a conveyance direction of the recording medium.

It is still another object of the present invention to provide an ink jet recording apparatus having high image recording quality by suppressing the waving of the recording medium due to ink droplets in performing the image recording using an ink jet recording head provided with a long discharge port array along a conveyance direction of the recording medium.

It is another object of the present invention to provide an ink jet recording apparatus having high image recording quality by retaining a suitable interval between an ink jet recording head and a recording medium in performing the image recording onto the recording medium with the same pixel overwritten by multiple ink discharges.

It is still another object of the present invention to provide an ink jet recording apparatus having high image recording quality by suppressing the waving of the recording medium due to ink droplets in performing the image recording onto the recording medium with the same pixel overwritten by multiple ink discharges.

It is another object of the present invention to provide an ink jet recording apparatus having high image recording quality by retaining a suitable the interval between an ink jet recording head and a recording medium in performing the image recording onto the recording medium with the same pixel overwritten by multiple ink discharges using an ink jet recording head provided with a long discharge port array along a conveyance direction of the recording medium.

It is still another object of the present invention to provide an ink jet recording apparatus having high image recording quality by suppressing the waving of the recording medium due to ink droplets in performing the image recording onto the recording medium with the same pixel overwritten by multiple ink discharges using an ink jet recording head provided with a long discharge port array along a conveyance direction of the recording medium.

It is a further object of the present invention to provide an ink jet recording apparatus having an image recording area which performs the image recording onto the recording medium using an ink jet recording head for discharging the ink through ink discharge ports, comprising a head holding portion for holding the ink jet recording head, a platen having a planar section for supporting the recording medium opposed to the ink discharge ports in the image recording area, and a facial section disposed downstream of said image recording area with respect to a conveyance direction of the recording medium, and extending in a direction away from said ink discharge ports toward said conveyance direction, and recording medium exhausting means, disposed downstream of the facial section of said platen in said conveyance direction, for exhausting said recording medium out of said recording area by guiding said recording medium from extension of the planar section of said platen in a direction closer to the facial section of said platen.

It is a further object of the present invention to provide an ink jet recording apparatus which performs the image recording onto the recording medium using an ink jet recording head for discharging the ink through ink discharge ports, comprising a first region for supporting the recording medium, out of contact with said ink discharge ports, on a planar platen opposed to the ink discharge ports, said first region causing the recording medium to undergo rugged deformation due to sticking of the ink downstream in a conveyance direction of said recording medium, and a second region for preventing contact between said recording medium which has undergone rugged deformation and said ink discharge ports, said second region having a facial platen disposed downstream of said first region with respect to the conveyance direction of said recording medium and extending away from a conveyance passageway of said recording medium, and recording medium exhausting means for conveying said recording medium in a direction away from extension of the planar platen in said first region.

DETAILED DESCRIPTION OF PREFERRED EMBODIMENTS

EXAMPLE 1

Figure 1:
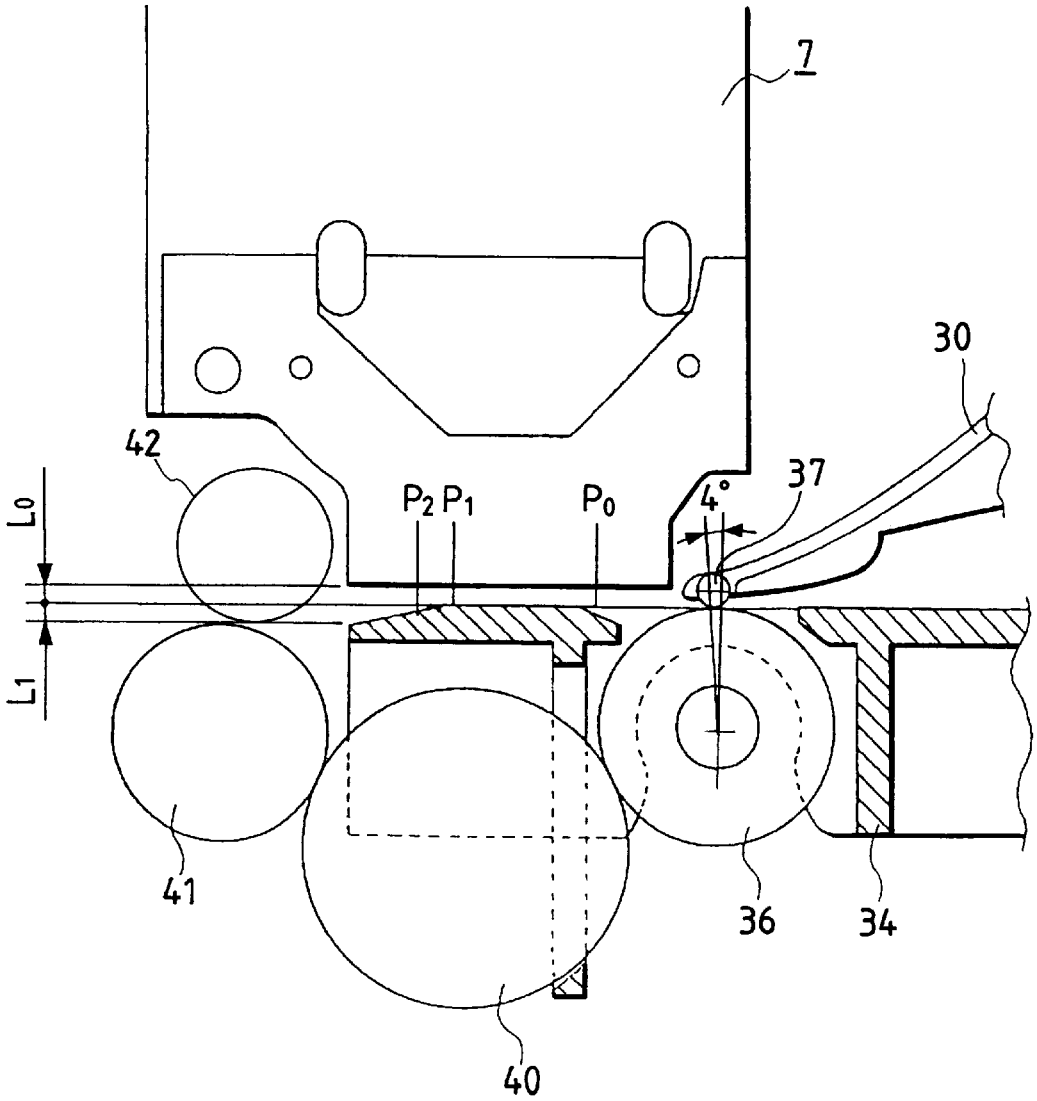
FIG. 1 is a typical cross-sectional view showing the constitution of a main portion in a first example of the present invention.

An example 1 of the present invention will be now described with reference to FIGS. 1 to 9. A recording apparatus 1 having an automatic feeder is comprised of a paper supply portion 2, a paper feeding portion 3, a paper exhausting portion 4, a carriage portion 5, and a cleaning portion 6.

Figure 2:
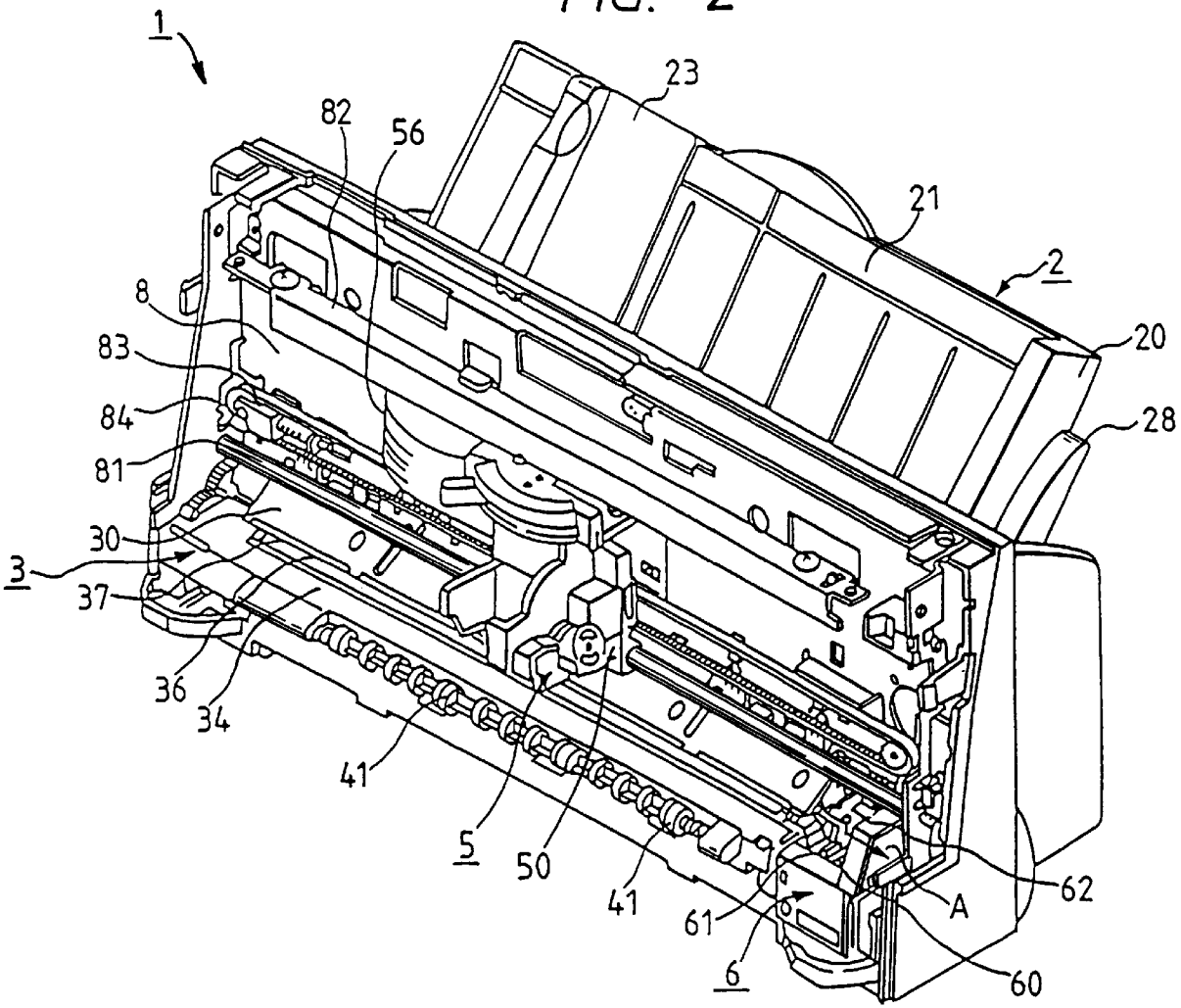
FIG. 2 is a typical perspective view showing the overall constitution of a recording apparatus in the example of the present invention.
Figure 3:
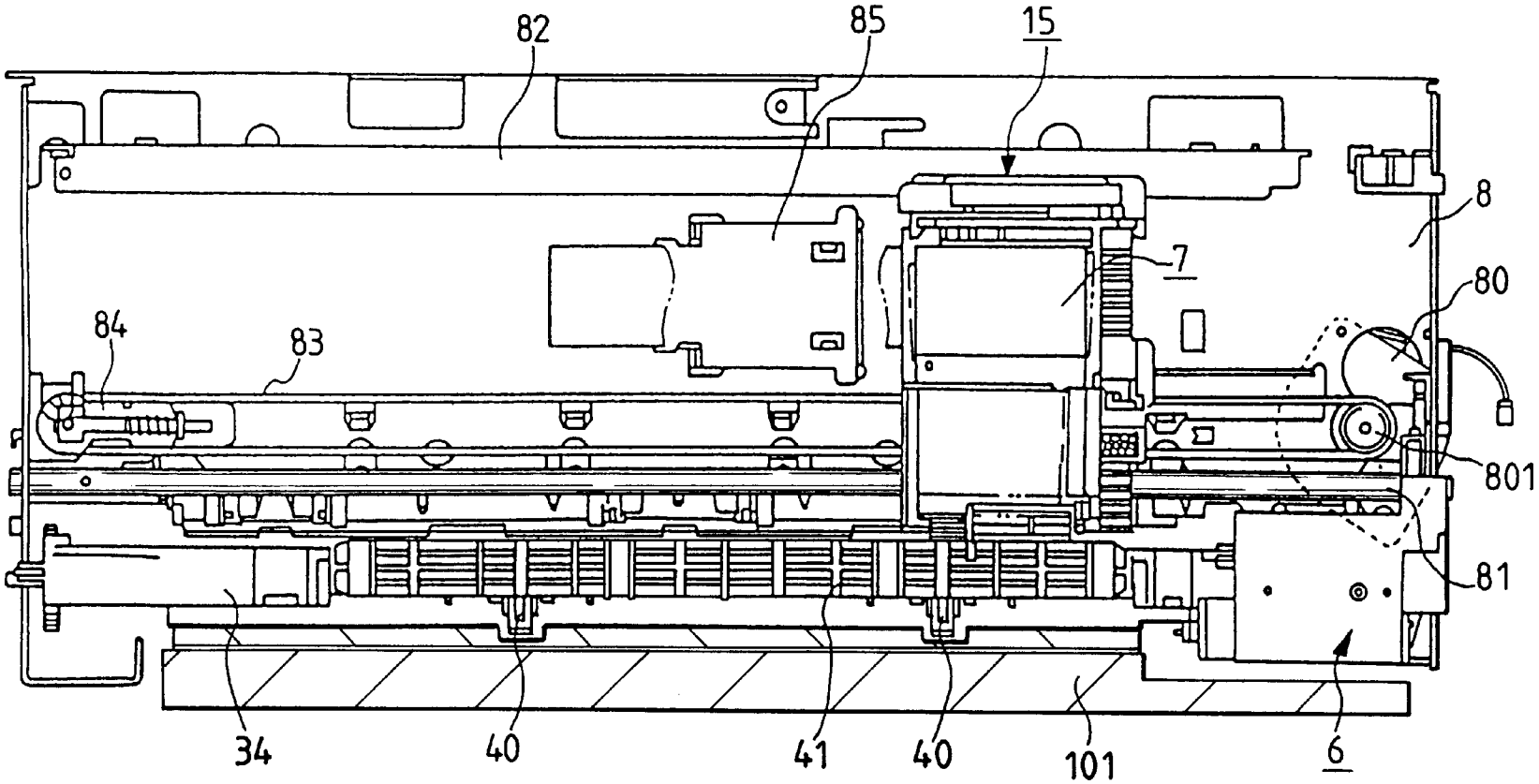
FIG. 3 a typical front view of the recording apparatus in the example of the present invention.
Figure 4:
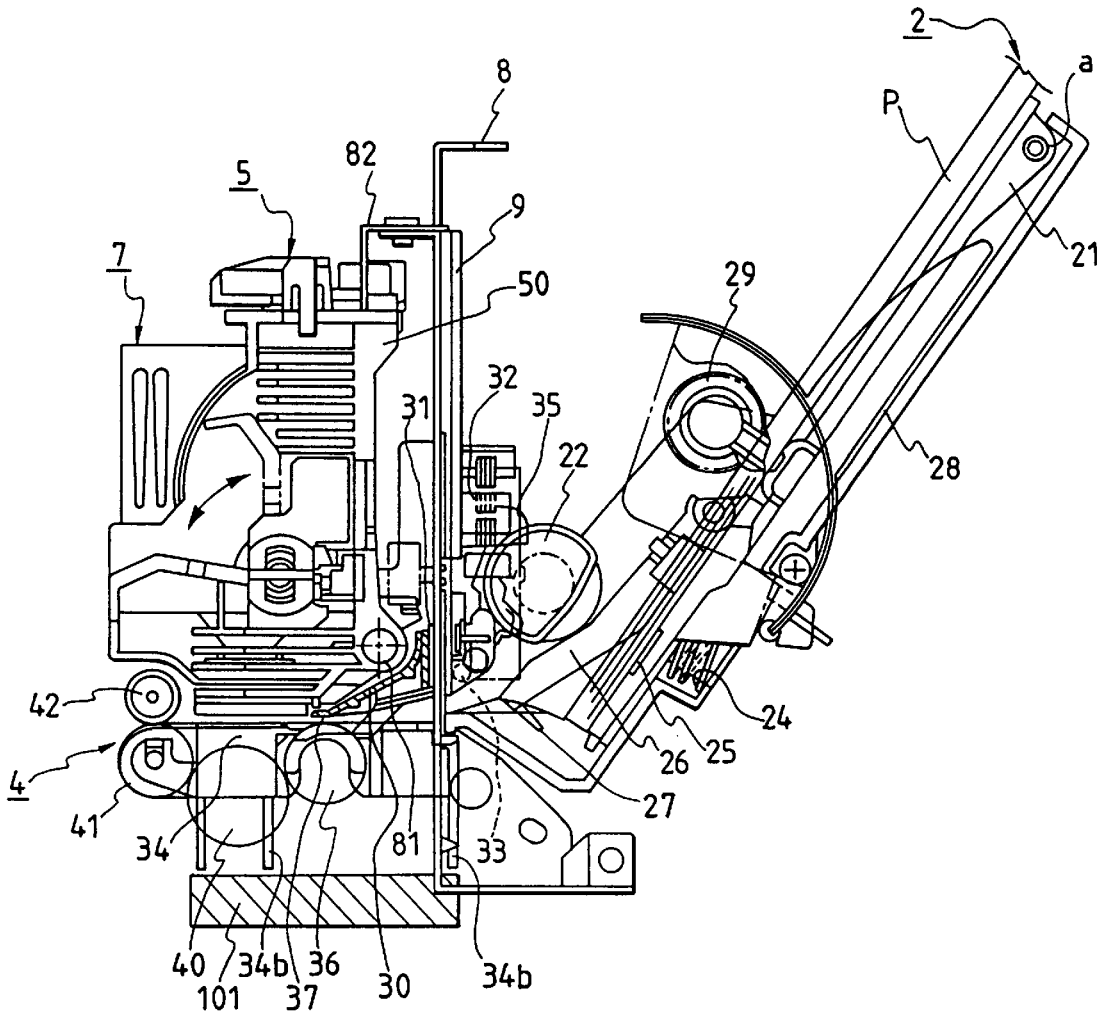
FIG. 4 is a typical constitutional cross-sectional view of the recording apparatus in the example of the present invention.
Figure 5:
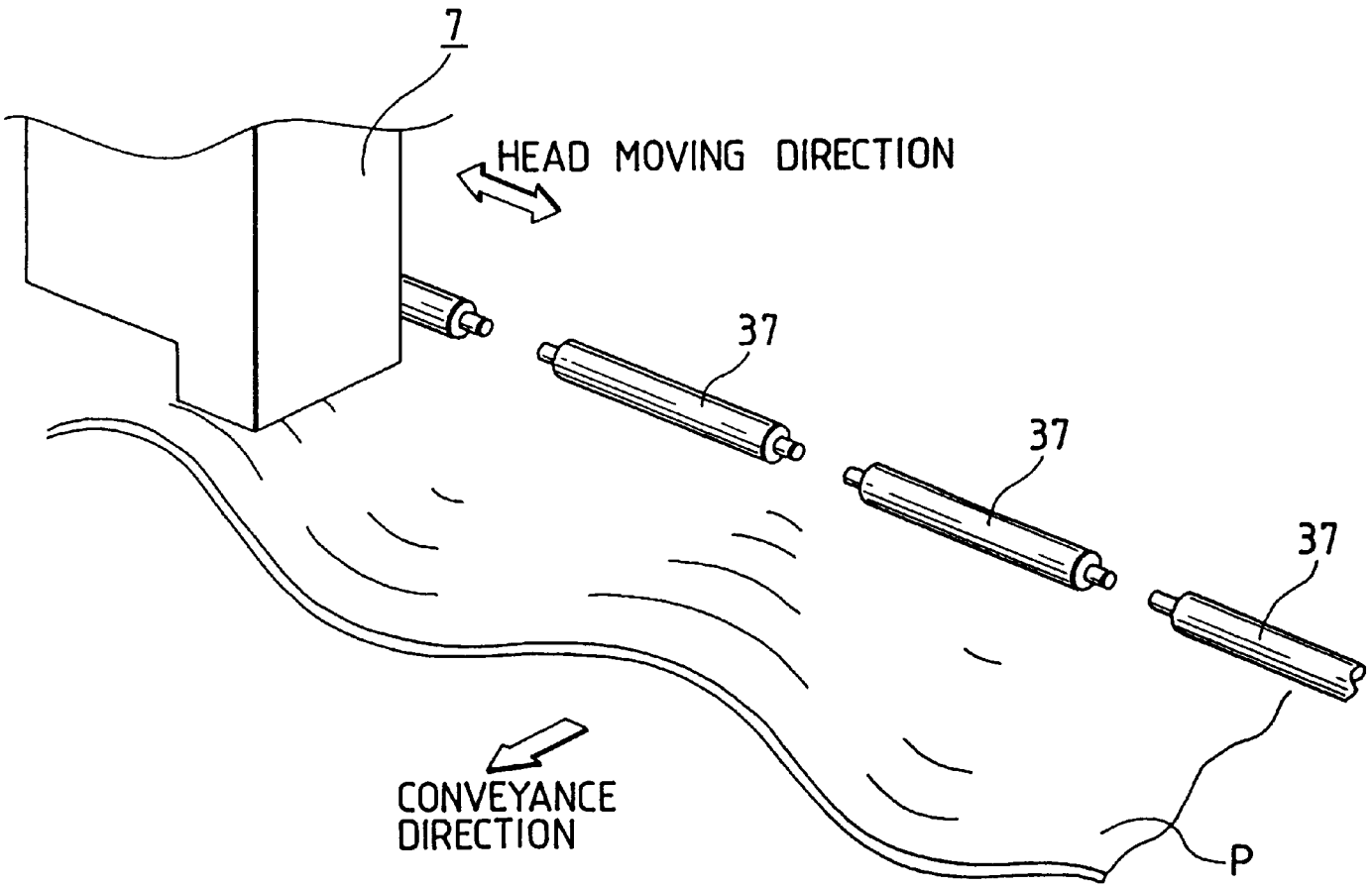
FIG. 5 PRIOR ART
FIG. 5 is a perspective view typically showing the occurrence of waving in a conventional example.
Figure 6:
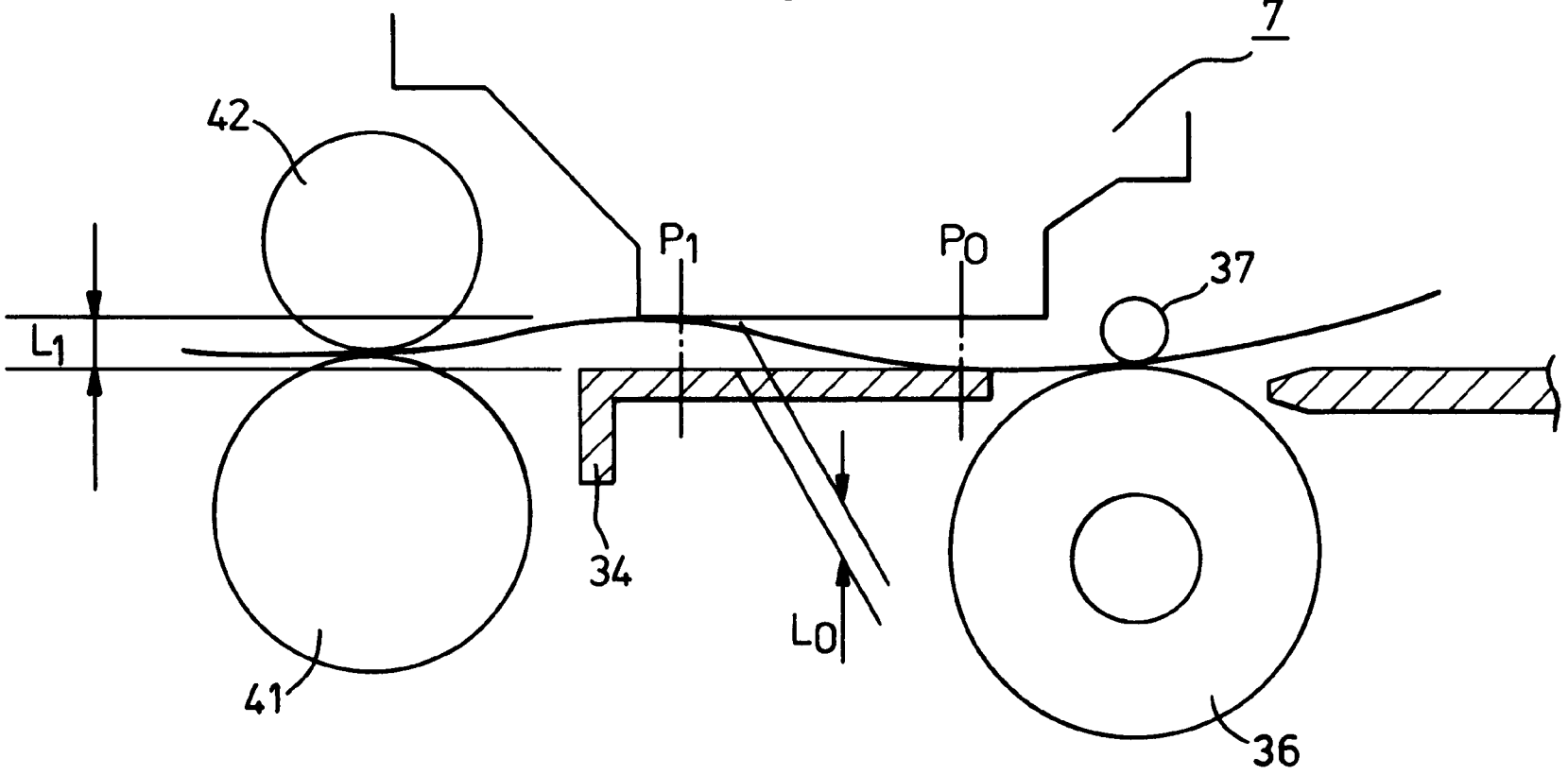
FIG. 6 PRIOR ART
FIG. 6 is a cross-sectional view typically showing the occurrence of waving in the conventional example.

Each of the above items will be schematically described below in order. Herein, FIG. 2 is a perspective view showing the overall constitution of the recording apparatus 1, FIG. 3 is a front view of the recording apparatus 1, and FIG. 4 is a constitutional cross-sectional view of the recording apparatus 1. Reference is made to FIGS. 2 to 4 to explain the paper supply portion 2, the paper feeding portion 3, the paper exhausting portion 4, the carriage portion 5 and the cleaning portion 6.

(Paper supply portion 2)

The paper supply portion 2 is configured to have a pressure plate 21 for loading the recording sheet P and a supply body of revolution 22 for supplying the recording sheet P which are attached to a base 20. The pressure plate 21 is movably provided with a movable side guide 23 to regulate the loading position of the recording sheet P. The pressure plate 21 is rotatable around a rotational shaft 1*a* connected to the base 20, and urged toward the supply body of revolution 22 by a pressure plate spring 24. Provided at a portion of the pressure plate 21 facing the supply body of revolution 22 is a separating pad 25 made of a material having large frictional coefficient such as an artificial leather to prevent the recording sheet P from moving under the gravitational force.

Further, disposed on the base 20 are a separation claw 26 for separating the recording sheet P one by one by covering the corner of the recording sheet P in one sense, a bank portion 27 formed integrally with the base 20 for separating those such as cardboards which can not be separated by the separation claw, a switch lever 28 for switching the separation claw 26 to take action in the ordinary paper position and not in the cardboard position, and a release cam 29 for releasing the contact between the pressure plate 21 and the supply body of revolution 22.

In the above constitution, the release cam 29 forces the pressure plate 21 upward to a predetermined position in a standby state. Thereby, the contact between the pressure plate 21 and the supply body of revolution 22 is released. In this state, if a drive force which a conveying roller 36 has is transmitted via the gears to the supply body of revolution 22 and the release cam 29, the release cam 29 leaves away from the pressure plate 21 to cause the pressure plate 21 to rise, so that the supply body of revolution 22 and the recording sheet P are contacted, causing the recording sheet P to be picked up along with the rotation of the supply body of revolution 22 to start the supply of paper, separated one by one by the separation claw 26 and delivered to the paper feeding portion 3.

The supply body of revolution 22 and the release cam 29 are rotated until the recording sheet P is delivered into the paper feeding portion 3, thereby coming to the standby state where the contact between the recording sheet P and the supply body of revolution 22 is released, whereby the driving force from the conveying roller 36 is disconnected.

(Paper feeding portion 3)

The paper feeding portion 3 is comprised of a conveying roller 36 for conveying the recording sheet P and a paper edge (PE) sensor 32. The conveying roller 36 is provided in contact with a pinch roller 37 which is driven. The pinch roller 37 is held on a pinch roller guide 30, which is biased by a pinch roller spring 31 to place the pinch roller 37 into contact with the conveying roller 36, thereby producing a conveying force for the recording sheet P. Further, at the entrance of the paper feeding portion 3 into which the recording sheet P is conveyed, an upper guide 22 for guiding the recording sheet P and a platen 34 are disposed.

Also, the upper guide 33 is provided with a PE sensor lever 35 for transmitting the sensing of the leading and trailing end of the recording sheet P to the PE sensor 32. Further, a recording head 7 for forming the image based on image information is provided downstream of the conveying roller 36 in the recording sheet conveyance direction.

In the above constitution, the recording sheet P delivered to the paper feeding portion 3 is fed to a pair of rollers consisting of the conveying roller 36 and the pinch roller 37, guided by the platen 34, the pinch roller guide 30 and the upper guide 33. At this time, the PE sensor lever 35 senses the leading end of the recording sheet P which has been conveyed, thereby to determine the print position of the recording sheet P. Also, the recording medium P is conveyed on the platen 34 as the pair of rollers 36, 37 are rotated by an LF motor, not shown.

Note that the recording head 7 is an easily replaceable ink jet recording head which is integrally formed with an ink tank. The recording head 7 can apply heat to the ink by means of a heater. And owing to this heat, the ink causes film boiling, which produces pressure changes by growth or shrinkage of bubbles, so that the ink is discharged through discharge nozzles 70 of the recording head 7 to form the image on the recording sheet P.

(Paper exhausting portion 4)

The paper exhausting portion 4 has a transmission roller 40 in contact with the conveying roller 36 and a paper exhausting roller 41 in contact with the transmission roller 40. Accordingly, a drive force of the conveying roller 36 is transmitted via the transmission roller 40 to the paper exhausting roller 41. Also, a spur 42 is placed into contact with the paper exhausting roller 41 to be rotatable by following the motion of the paper exhausting roller 41. With the above constitution, the recording sheet P having image formed in the carriage portion 5 is carried and conveyed between the paper exhausting roller 41 and the spur 42, and exhausted onto a paper exhausting tray, not shown.

(Carriage portion 5)

The carriage portion 5 has a carriage 50 for carrying the recording head 7. And the carriage 50 is supported by a guide shaft 81 for scanning reciprocally in the directions crosswise or orthogonal to the conveyance direction of the recording sheet P, and a guide rail 82 for maintaining the gap between the recording head 7 and the recording sheet P by holding the trailing end of the carriage 50.

Note that the guide shaft 81 and the guide rail 82 are attached to a chassis 8. Also, the carriage 50 is driven via a timing belt 83 by a carriage motor 80 mounted to the chassis 8. This timing belt 83 is extended and supported by an idle pulley 84. Further, the carriage 50 comprises a flexible substrate 56 for transmitting a head signal from an electrical substrate 9 to the recording head 7.

In the above constitution, in forming the image on the recording sheet P, a pair of rollers 36, 37*b* convey the recording sheet P through the conveyance passageway of the recording sheet P, while the recording head 7 is placed opposed to the image forming position by moving the carriage 50 in a direction orthogonal to the conveyance direction of the recording sheet P by the carriage motor 80. Thereafter, the recording head 7 discharges the ink onto the recording sheet P upon a signal from the electrical substrate 9 to form the image.

(Cleaning portion 6)

The cleaning portion 6 is comprised of a pump 60 for cleaning the recording head 7, a cap 61 for preventing drying of the recording head 7, and a drive switching arm 62 for switching the driving force from the conveying roller 36 to the paper supply portion 2 and the pump 60.

The drive switching arm 62 fixes a planetary gear (not shown) at a predetermined position, which gear is rotatable around an axis of the conveying roller 36, except during the paper supply and cleaning operation, so that no driving force is transmitted to the paper supply portion 2 and the pump 60. If the carriage 50 is moved to shift the drive switching arm 62 in a direction of the arrow A, the planetary gear can be freed, and the planetary gear can be moved in accordance with the forward or backward rotation of the conveying roller 36, whereby when the conveying roller 36 is rotated in a forward direction, the driving force is transmitted to the paper supply portion 2, or when rotated in a backward direction, the driving force is transmitted to the pump 60.

Next, the details of the present invention will be described below.

First, the scheme for waving which may occur on the recording sheet due to sticking of ink droplets onto the recording sheet will be described below. The waving phenomenon will occur because ink droplets permeate into the recording sheet P to swell the recording sheet, or such ink droplets dry thereon. Therefore, the waving phenomenon does not occur immediately after ink discharge but starts to occur after elapse of a certain time necessary for the permeation and drying, and further the waving amount will maximize after elapse of a further certain time. Accordingly, the waving is likely to occur when the ink is discharged multiple times onto growingly waving surface, that is, in the so-called multi-path printing of recording image over the same image recording area multiple times.

Figure 7A:
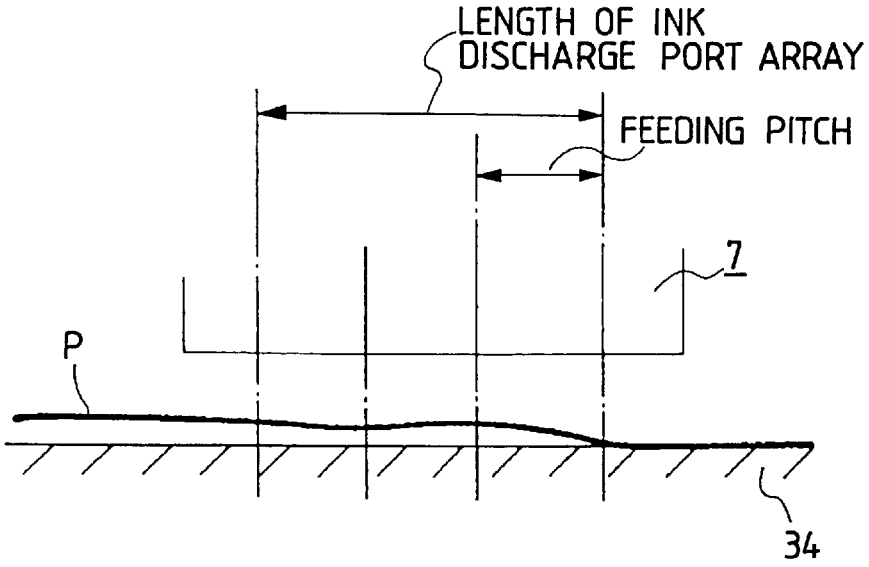
FIGS. 7A to 7C are typical explanatory views showing a scheme for waving occurrence.
Figure 7B:
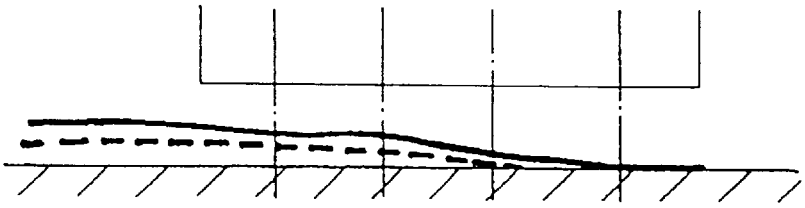
Figure 7C:
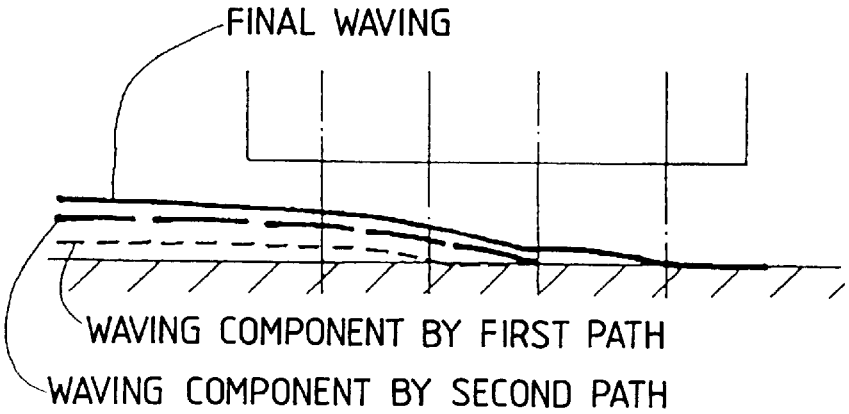

FIGS. 7A to 7C are typical views showing the states of waving which occurs in the three path printing. In this case, the conveyance amount of recording sheet in one path is set to one-third the length of an array of all nozzles disposed in series along the conveyance direction of the recording sheet. At the first path (FIG. 7A), the waving which has occurred most upstream of the image recording area moves downstream by a set pitch feed amount at the second path (FIG. 7B), and grows (dotted line). Moreover, it is synthesized with waving which has occurred at the second path to have a further greater waving (solid line). At the third path (FIG. 7C), the waving is further growing.

The actual situation of waving may depend on the image pattern or recording control method such as conveyance speed in each path, conveyance amount, and discharge amount of ink, the physical properties of medium such as the permeation of the ink into the recording sheet, and fast drying, and the ambient environment such as temperature and humidity, whereby it is difficult to say in general that the states are exactly the same as shown in FIGS. 7A to 7C. In practice, it is seen that there is a tendency in most cases that the waving increases multiplicatively downstream of the recording head in the conveying direction, as shown in FIGS. 7A to 7C.

Figure 8A:
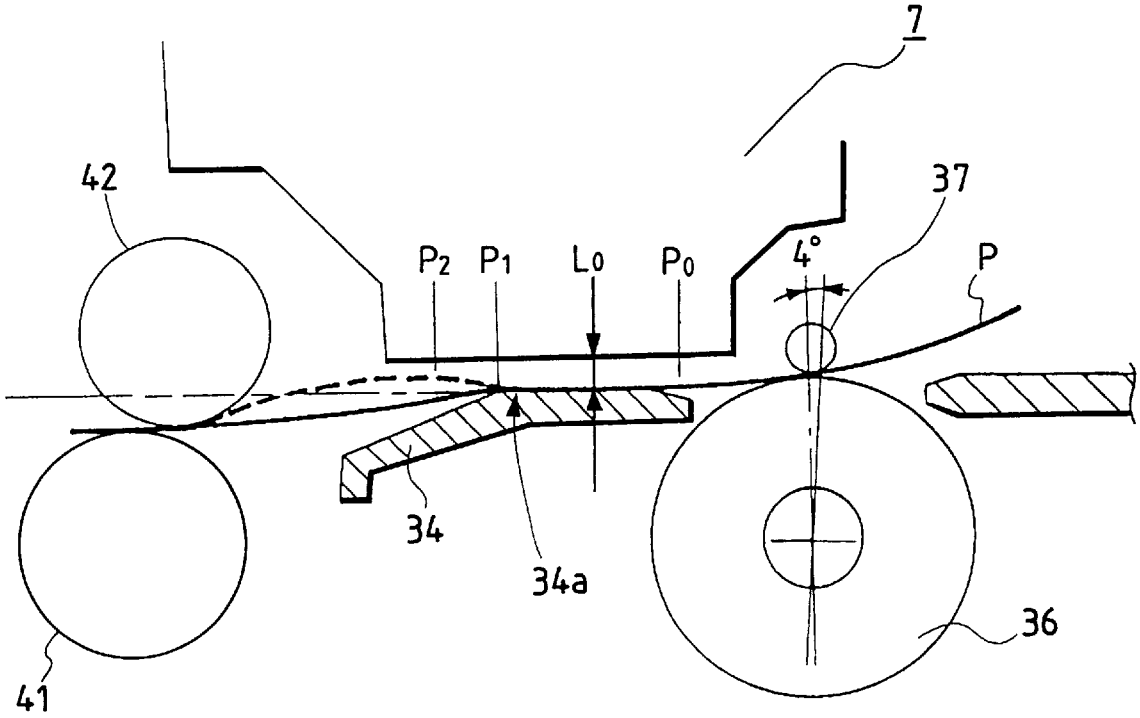
FIGS. 8A and 8 are typical explanatory views showing the action and effect of the present invention.
Figure 8B:
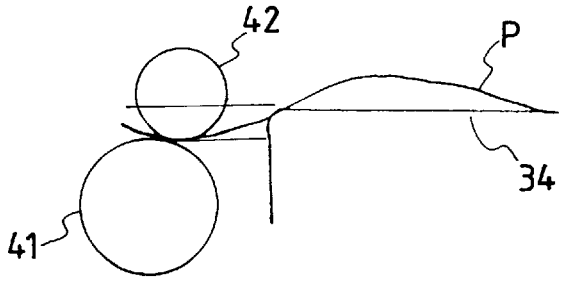
Figure 9:
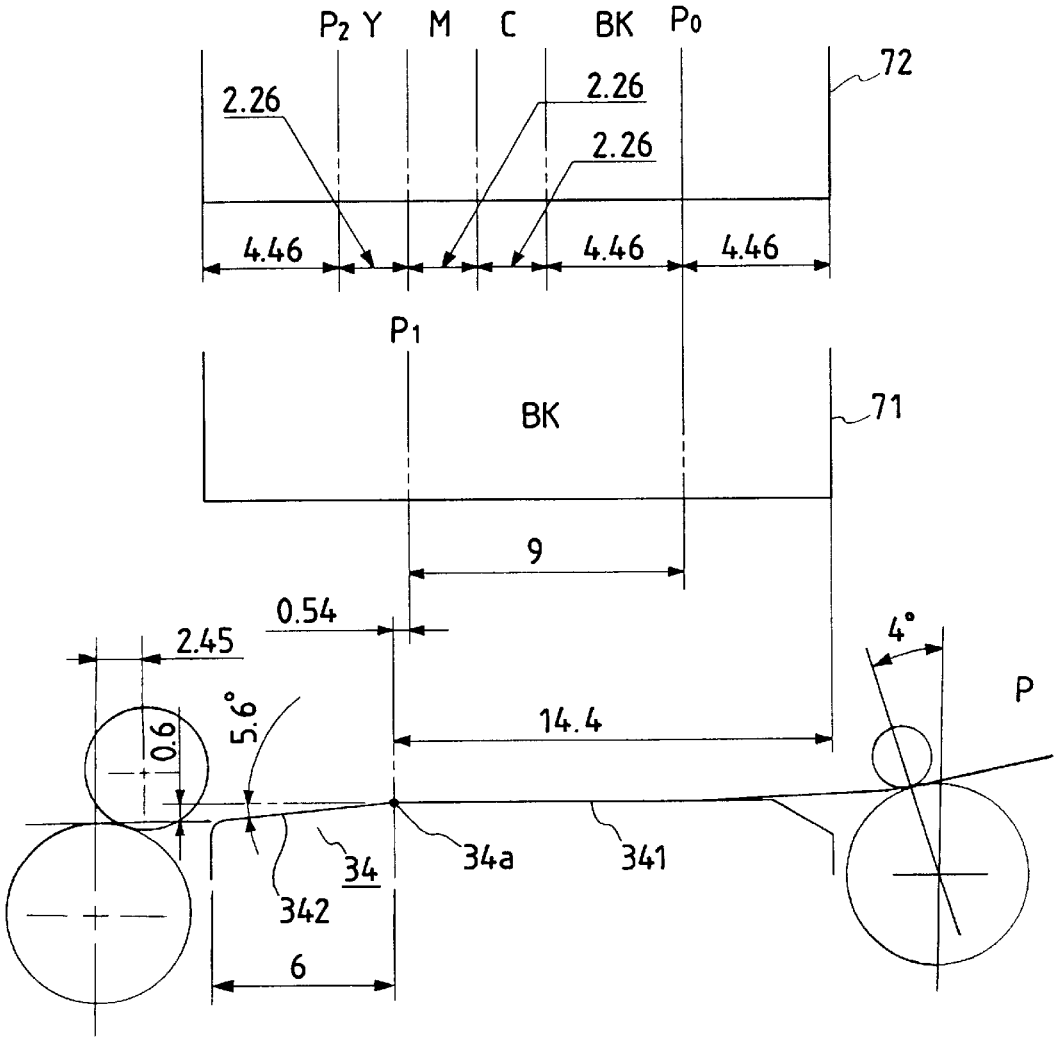
FIG. 9 is a typical cross-sectional view showing the configuration of the main portion in the first example of the present invention.

FIGS. 8A, 8B and 9 show detailed typical constitutional views of a main portion in this example. Using these figures, the details for each main portion of the paper feeding portion 3 and the platen corresponding to the recording sheet guide surface, the recording sheet exhausting portion comprised of the paper exhausting roller 41 and the spur 42, and the recording head 7 carried on the carriage 50 will be described below. In this example, the recording head 7 is replaceable between a monochrome head 71 for image recording using only the black ink and a color head 72 for full-color image recording using the inks of black (Bk), cyan (C), magenta (M) and yellow (Y), which head is carried on the carriage to form a desired ink image on the recording sheet P.

The monochrome head 71 has an image recording density of 360 dpi, and the number of ink discharge ports (nozzles) of 128, with the most upstream position of ink discharge port in the conveyance direction of the recording sheet P being $P_0$ and the most downstream position of ink discharge port being $P_1$. Herein, $P_0$ is a position 4.86 mm away from the most upstream end of the ink discharge port face (the face where 128 ink discharge ports are arranged in series along the conveyance direction of the recording sheet P) of the monochrome head 71, and $P_1$ is a position 9 mm downstream from $P_0$.

On the other hand, the color head 72 has 64 black ink discharge ports and 24 discharge ports for each of cyan ink, magenta ink and yellow ink, with the most upstream position of ink discharge port being $P_0$ and the most downstream position of ink discharge port being $P_2$ $P_2$ is an identical position to that of the monochrome head 71, a black ink discharge port array portion extending from $P_0$ to a 4.46 mm downstream position, and further downstream, a cyan ink discharge port portion, a magenta ink discharge port portion and a yellow ink discharge port portion being arranged at an equal interval of 2.26 mm.

Recording medium conveying means for guiding the recording sheet P to the image recording area has the pinch roller 37 and the paper feeding roller 36 disposed on respective sides of the recording sheet conveyance passageway. Herein, they are disposed such that the shaft center of the pinch roller 37 is located on the diametral line rotated about 4 degrees downstream in the conveyance direction of the recording sheet P along the peripheral surface of the paper feeding roller 36. With this constitution, the recording sheet P is guided and conveyed toward the planar section 341 of the platen 34 to come into contact therewith. The gap between the ink discharge port face of the recording head and the planar section 34 of the platen is set at about 1.2 mm.

The platen 34 forms a face extending from the upstream end of the recording head in the conveyance direction of the recording sheet P via a bent portion 34*a* at a position 14.4 mm downstream to the planar section 341 to a slant portion 342. This slant portion extends at an inclination of 5.6±1.9 degrees downward, or preferably 5.6±1 degrees, from the extension of the planar section 341 extending downstream of the bent portion 34*a*. The downstream end of the slant portion 342 is positioned at a location 6 mm downstream from the bent portion 34*a*, and 0.6±0.2 mm downward from the extension of the planar section 341.

Recording medium exhausting means for exhausting the recording sheet P out of the image recording area has the paper exhausting roller 41 (with a diameter of 16 mm) and the spur 42 (with a diameter of 10 mm) disposed on respective sides of the recording sheet conveyance passageway. Herein, the spur 42 is disposed such that the shaft center of the spur 42 is located at a position displaced about 2.45 mm upstream of the shaft center of the paper exhausting roller 41. The position of carrying the recording sheet P between the paper exhausting roller 41 and the spur 42 may vary with the thickness of recording sheet P and the elasticity of recording sheet P itself, but substantially provided at a position 0.6 mm downward from the extension of the planar section 341 of the platen 34.

The operation of image recording with the above constitution will be described below.

The recording sheet P conveyed by the pinch roller 37 and the paper feeding roller 36 is conveyed toward the planar section 341 of the platen 34 to be guided into the image recording area. At this time, the recording sheet P is urged or pressed onto the planar section 341 due to elasticity of the recording sheet P itself, so that a certain extent of deformation or waving phenomenon as previously cited can be corrected.

Then, the recording sheet P is conveyed to a position facing the ink discharge ports of the recording head 7, supported on the planar section 341 of the platen 34. In this example, the planar section 341 extends to a position covering the total length of the ink discharge port array in the case of the monochrome head 71. Also, in the case of the color head 72, the bent portion 34*a* is located opposed to a position lying in part over the yellow ink discharge port array. Disposed downstream of the bent portion 34*a* is the slant portion as previously mentioned, through which the recording sheet P is guided into a recording sheet exhausting portion comprised of the paper exhausting roller 41 and the spur 42. As previously described, the recording sheet exhausting portion carries therebetween the recording sheet P downward from the extension of the planar section 341, resulting in the greater effect of bringing the recording sheet P into closer contact with the planar section 341 of the platen 34, and the enhanced action of suppressing the rugged deformation of the recording sheet P or a so-called waving phenomenon. At this time, the degree of contact of the recording sheet P with the planar section 341 can be further strengthened owing to the slant portion 342.

Herein, where the slant portion 342 is provided in the platen 34 as shown in FIG. 8B, it occurs that the recording sheet P rises up, inversely, at the corner of the end portion downstream of the platen 34. On the other hand, where the inclination of slant portion 342 is too large, the recording sheet P is permitted to undergo excessive deformation downward, so that the trailing end of the recording sheet P is turned upward. The inclination of this slant portion 342 is made at an angle as cited previously, thereby allowing to escape the deformation of the recording sheet P downward, while suppressing excessive downward deformation of the recording sheet P, so that the recording sheet can be exhausted out of the image recording area in the most preferable condition.

Also, because the bent portion 34*a* is provided at a previously-mentioned position, in the case of the monochrome head 71 normally using black ink, the gap between the ink discharge port face and the platen 34 (or between the ink discharge port face and the recording sheet P) can be maintained as invariable as possible, whereby in overwriting as shown in FIGS. 7A to 7C, it is possible to suppress the impingement error of the ink onto the recording sheet P to the minimum to accomplish the image recording with high quality.

Further, in the case of using a color head for performing full-color image recording by overwriting with the ink discharged through ink discharge ports for each color, the gap between the ink discharge port face and the platen 34 (or between the ink discharge port face and the recording sheet P) is maintained as invariable as possible in the ink discharge region of black, cyan and magenta, with the recording sheet P being guided by the slant portion 342 in the yellow ink discharge region which has less contrast than other three colors, whereby even if there occurs an error in the impingement of the yellow ink onto the recording sheet P, the image recording can be made almost inconspicuously, and the recording sheet P can be less subject to deformation in the discharge region of the yellow ink which may otherwise increase the deformation of the recording sheet P because of its most downstream location.

It should be noted that the bent portion 34*a* may be located near and downstream of a position confronting the total length of ink discharge port array for the monochrome head 71, and further can be located in the vicinity of the yellow ink discharge port array of the color head 72 and its adjacent magenta ink discharge port array, and substantially with the same effect as previously described.

With the above constitution, the deformation such as undulation or waving can be suppressed and corrected, so that the high quality image recording is permitted. Also, in the case of the monochrome head 71 having a long discharge port array extending along the conveyance direction of the recording sheet P, the ruled line deviation can be suppressed.

That is, it is possible to gain wide acceptance from the high duty image recording for overwriting to the image recording with the recording head having a long discharge port array along the conveyance direction of the recording sheet P, while exhibiting the same effect as previously described.

EXAMPLE 2

Figure 10:
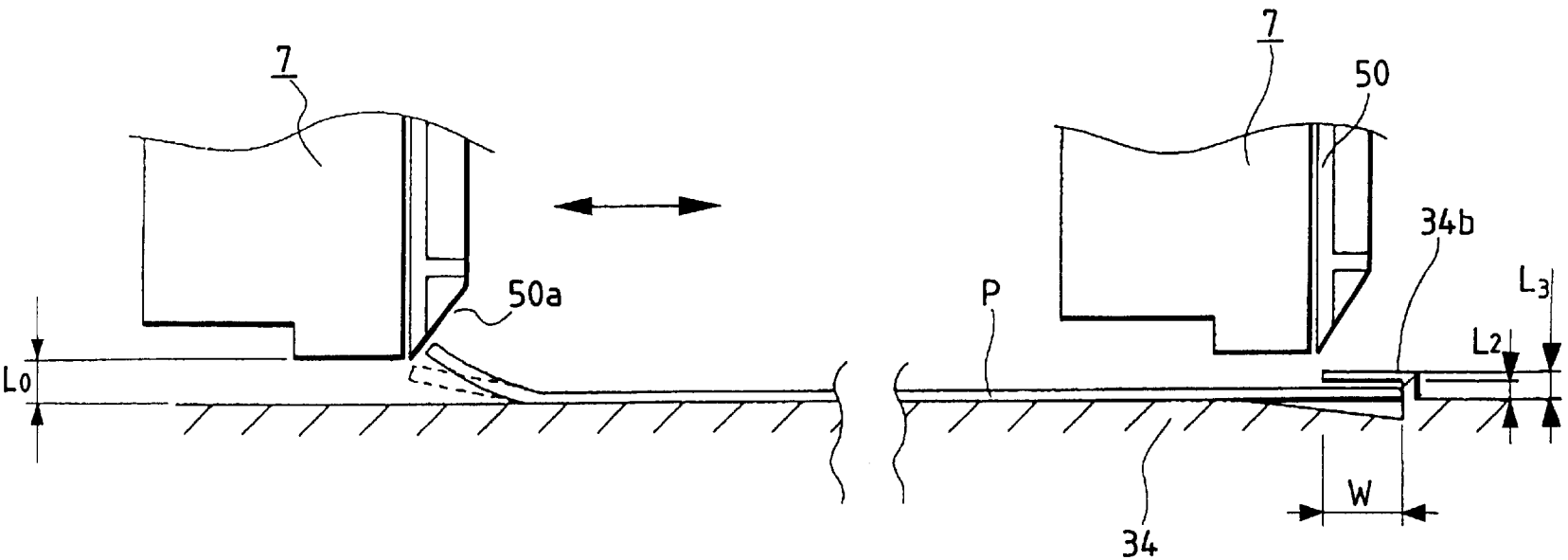
FIG. 10 is a typical cross-sectional view for explaining a second example of the present invention.
Figure 11:
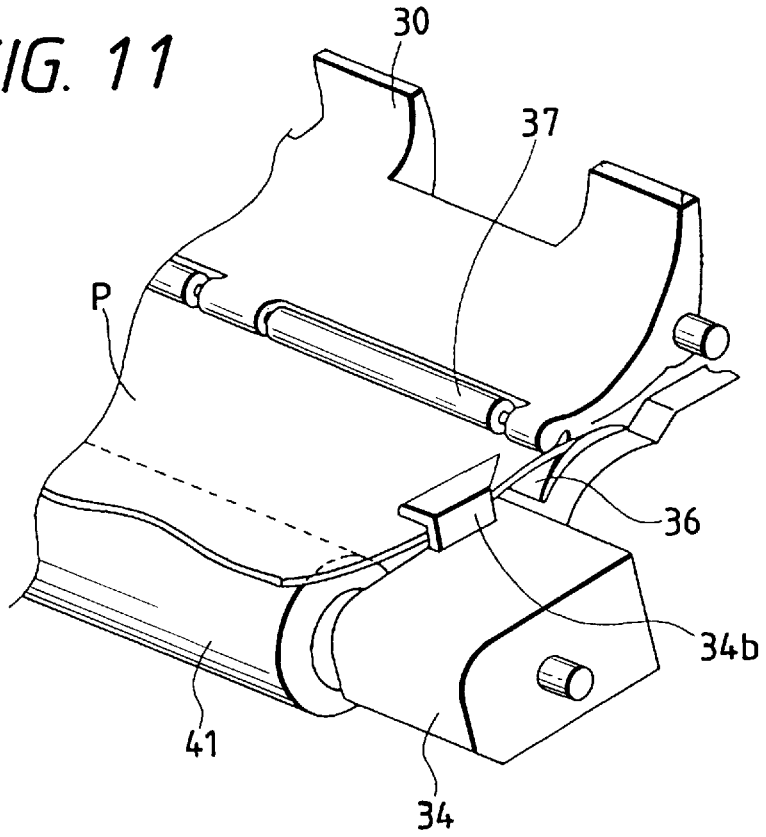
FIG. 11 is a typical perspective view for explaining the second example of the present invention.
Figure 12:
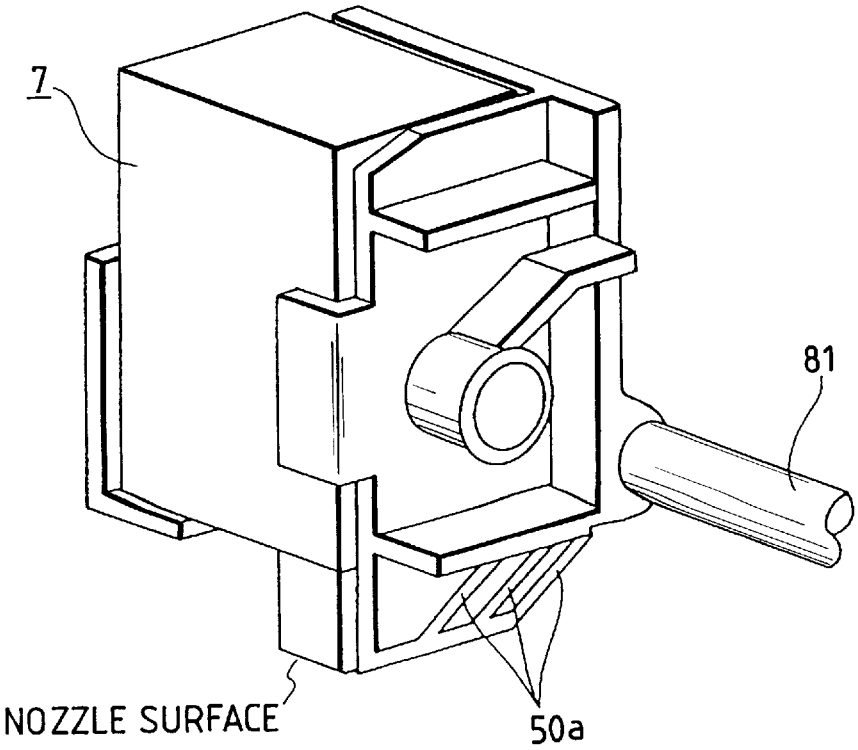
FIG. 12 is a typical perspective view for explaining the second example of the present invention.

An example 2 of the present invention will be described below, based on FIGS. 10 to 12. FIGS. 10 to 12 show an example wherein the platen is given a shape of pressing down the recording sheet at one end on the recording face side to prevent floating of the end portion, and the carrier is given a shape for preventing the other end of the recording sheet from floating up and abutting against the running carrier or the recording head mounted on the carrier.

FIG. 10 is a typical cross-sectional view of the present example, the right end portion of the recording sheet P being carried between the upper face of platen and a floating preventing member 34*b* to have at least the distance L0–L2 separate away from the recording head nozzle face. Also, even if the left end portion of the recording sheet P floats, a jam preventing rib 50*a* provided on the carrier can escape down the paper end portion which has abutted thereagainst, whereby the occurrence of jam between the carrier and the recording sheet can be prevented.

In this example, L2 and L3 are set to 0.5 and 0.7, respectively, so that no contact between the lower surface of recording head and the floating preventing member 34*b* occurs. Also, the weight W of floating preventing member 34*b* acting on the recording sheet is set at 2 mm. Because the recording margin is provided with at least 2.4 mm, none of the left and right recording areas are narrowed by the floating preventing member 34*b*.

FIGS. 11 and 12 show typical perspective views of the floating preventing member 34*b* and the jam preventing rib 50*a*, respectively. It is needless to say that any other shapes than presented in the present invention may be contained within the scope of the invention as long as they can prevent the recording sheet P from floating upward at one end and abutting onto the carrier at the other end.

EXAMPLE 3

While in the previous examples, an ink jet recording apparatus of the serial type of scanning along the recording sheet P with the recording head 7 mounted on the carriage 50 was exemplified, it will be understood that in this example, the present invention is also applicable to an ink jet recording head of the line type in which a line type recording head corresponding to the entire or partial recording width of the recording sheet P is used, and with the same effect.

(Others)

Recording means (recording head) 7 may be of a cartridge type having a recording head and an ink tank integrated together, or have a recording head and an ink tank provided separately and connected via a tube, wherein the present invention can be applied to whatever constitution of the recording head and the ink tank, and with the same effect.

The present invention is applicable to an ink jet recording apparatus, for example, using recording means (recording head) with electricity-stress converters such as piezoelectric elements, and brings about excellent effects particularly in an ink jet recording apparatus using recording means of a system of discharging the ink with the heat energy. With such system, the higher density and higher resolution recording can be achieved.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electrothermal converters arranged corresponding to the sheets or liquid paths holding a liquid (ink), heat energy is generated at the electrothermal converters to effect film boiling at the heat acting surface of the recording means (recording head), and consequently the bubbles within the liquid (ink) can be formed corresponding one by one to the driving signals.

By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electrothermal converters or another type of heating elements, or preliminary heating means according to a combination of these, and it is also effective for performing stable recording to perform preliminary mode which performs discharging separate from recording.

Further, in addition, an ink jet recording apparatus according to the present invention may take the forms of an image output terminal for an information processing equipment such as a computer, a copying machine in combination with a reader, or a facsimile terminal equipment having the transmission and reception features.

As above described, the examples according to the present invention can exhibit the following remarkable effects.

(1) Even if the waving phenomenon on the paper surface occurs upon recording the image using a recording apparatus of the ink jet system, possibly caused by permeation of the ink into the recording sheet, with the recording sheet laid in unstable recording surface condition, the waving can be suppressed or corrected to maintain the distance between the recording head and the recording sheet constant, so that the excellent image recording accuracy and quality can be assured.

(2) In the cases where the recording sheet itself floats at its end portion due to the causes that the storage condition is unfavorable or the trailing end of recording sheet goes out of conveying means, the image recording can be performed up to the end of the recording sheet, and in particular a large image recording area for the trailing end can be secured.

What is claimed is:

1. An ink jet recording apparatus having an image recording area which performs the image recording onto the recording medium using an ink jet recording head for discharging the ink through ink discharge ports, comprising:

a head holding portion for holding the ink jet recording head;

a platen having a planar section for supporting the recording medium opposed to the ink discharge ports in said image recording area, and a facial section disposed downstream of said image recording area with respect to a conveyance direction of the recording medium, and extending in a direction away from said ink discharge ports toward said conveyance direction, wherein said planar section and said facial section of said platen are continuous, an angle between an extension of said planar section and said facial section being from 3.7 degrees to 7.5 degrees; and recording medium exhausting means, disposed downstream of the facial section of said platen in said conveyance direction, for exhausting said recording medium out of said recording area by guiding said recording medium from the extension of the planar section of said platen in a direction closer to the facial section of said platen.

2. An ink jet recording apparatus according to claim 1, wherein the end portion of the facial section of said platen downstream with respect to the conveyance direction of said recording medium guides said recording medium at a position 0.4 mm to 0.8 mm apart from the extension of said planar section of said platen.

3. An ink jet recording apparatus according to claim 1, wherein the planar section of said platen is opposed to a discharge port array comprised of 128 ink discharge ports.

4. An ink jet recording apparatus according to claim 1, wherein said platen has a part of the facial section of said platen at a position confronting the discharge port array comprised of a plurality of said ink discharge ports.

5. An ink jet recording apparatus according to claim 1, wherein the planar section of said platen is substantially parallel to the discharge port face provided with said ink discharge ports.

6. An ink jet recording apparatus according to claim 1, wherein the planar section of said platen holds said recording medium so that the discharge port face provided with said ink discharge ports and said recording medium are out of contact and with a predetermined gap.

7. An ink jet recording apparatus according to claim 1, wherein a continuous section located between the planar section of said platen and the facial section of said platen is opposed to near the trailing end of an ink discharge port array in the conveyance direction of said recording medium, said ink discharge port array being formed of a plurality of ink discharge ports arranged in an ink jet recording head for monochrome recording along the recording medium conveyance direction.

8. An ink jet recording apparatus according to claim 1, wherein the continuous portion located between the planar section of said platen and the facial section of said platen is opposed to an ink discharge port array for yellow ink located at the trailing end of the discharge port array in the conveyance direction of said recording medium, said discharge port array being formed of a plurality of ink discharge ports arranged in an ink jet recording head for color recording along the recording medium conveyance direction.

9. An ink jet recording apparatus according to claim 1, wherein said recording medium exhausting means is a pair of rollers disposed on respective sides of the conveyance passageway through which said recording medium is conveyed, wherein a roller on the recording head side on said conveyance passageway is displaced toward said image area, as compared to a roller on the side of said platen on said conveyance passageway, to guide said recording medium.

10. An ink jet recording apparatus according to claim 1, wherein said recording medium exhausting means is a pair of rollers disposed on respective sides of the conveyance passageway through which said recording medium is conveyed, for guiding said recording medium at a position displaced 0.4 mm to 0.8 mm from the extension of the planar section of said platen toward said facial section of said platen.

11. An ink jet recording apparatus according to claim 1, wherein said ink jet recording apparatus has recording medium conveying means for guiding and conveying the recording medium in a direction of coming into contact with the planar section of said platen, upstream of said image recording area in said recording medium conveyance direction.

12. An ink jet recording apparatus according to claim 11, wherein said recording medium exhausting means is a pair of rollers disposed on respective sides of the conveyance passageway through which said recording medium is conveyed, wherein a roller on the recording head side on said conveyance passageway is displaced toward said image area, as compared to a roller on the side of said platen on said conveyance passageway, to carry said recording medium therebetween.

13. An ink jet recording apparatus according to claim 1, wherein different ink jet recording heads held on a head holding member are provided with electrothermal converters and discharge the ink through ink discharge ports with the heat energy generated by said electrothermal converters.

14. An ink jet recording apparatus according to claim 1, wherein said facial section is arranged below the extension of the planar section for guiding the recording medium downward from the extension of the planar section to compensate for deformation of the recording medium by swelling and floating up off the platen surface with the ink sinking into the recording medium.

15. An ink jet recording apparatus according to claim 1, wherein said recording medium exhausting means comprises a pair of exhausting rollers for pinching the recording medium downward of the facial section and a position where said pair of exhausting rollers pinch the recording medium is located spaced apart from said head holding portion and downward of the extension of said planar section.

16. An ink jet recording apparatus having an image recording area which performs the image recording onto the recording medium using an ink jet recording head for discharging the ink through ink discharge ports, comprising:

a head holding portion for holding the ink jet recording head;

a platen having a planar section for supporting the recording medium opposed to the ink discharge ports in said image recording area, and a facial section disposed downstream of said image recording area with respect to a conveyance direction of the recording medium, and extending in a direction away from said ink discharge ports toward said conveyance direction, wherein the end portion of the facial section of said platen downstream with respect to the conveyance direction of said recording medium guides said recording medium at a position 0.4 mm to 0.8 mm apart from the extension of said planar section of said platen; and recording medium exhausting means, disposed downstream of the facial section of said platen in said conveyance direction, for exhausting said recording medium out of said recording area by guiding said recording medium from the extension of the planar section of said platen in a direction closer to the facial section of said platen.

17. An ink jet recording apparatus according to claim 16, wherein said facial section is arranged below the extension of the planar section for guiding the recording medium downward from the extension of the planar section to compensate for deformation of the recording medium by swelling and floating up off the platen surface with the ink sinking into the recording medium.

18. An ink jet recording apparatus according to claim 16, wherein said recording medium exhausting means comprises a pair of exhausting rollers for pinching the recording medium downward of the facial section and a position where said pair of exhausting rollers pinch the recording medium is located spaced apart from said head holding portion and downward of the extension of said planar section.

19. An ink jet recording apparatus having an image recording area which performs image recording onto a recording medium using an ink jet recording head for discharging ink through ink discharge ports, said apparatus comprising:

a head mounting portion capable of mounting either a color ink jet recording head having a color discharge port array on which discharge ports for discharging a predetermined number of different color inks are arranged in line, or a monochrome ink jet recording head having a monochrome discharge port array, shorter than said color discharge port array, and on which discharge ports for discharging ink having a monochrome color are arranged in line; and a platen having a planar section for supporting the recording medium opposed to the ink discharge ports in the image recording area, said planar section being opposed to said monochrome discharge port array when said monochrome ink let recording head is mounted on said head mounting portion, and being opposed to said color discharge port array when said color ink jet recording head is mounted on said head mounting portion, and a slant section disposed downstream of said planar section and inclined away from said ink discharge ports, said slant section not being opposed to said monochrome discharge port array when said monochrome ink jet recording head is mounted on said head mounting portion, and being opposed to said color discharge port array when said color ink jet recording head is mounted on said head mounting portion.

20. An ink jet recording apparatus according to claim 19, wherein said planar section and said slant section are continuous, an angle made between an extension of said planar section and said slant section being from 3.7 degrees to 7.5 degrees.

21. An ink jet recording apparatus according to claim 19, wherein an end portion of said slant section downstream with respect to the conveyance direction of the recording medium guides the recording medium at a position 0.4 mm to 0.8 mm apart from an extension of said planar section of said platen.

22. An ink jet recording apparatus according to claim 19, wherein said planar section of said platen is opposed to the monochrome discharge port array, the monochrome discharge port array being comprised of 128 ink discharge ports.

23. An ink jet recording apparatus according to claim 19, wherein said planar section of said platen is substantially parallel to a discharge port face provided with said ink discharge ports.

24. An ink jet recording apparatus according to claim 19, wherein said planar section of said platen holds the recording medium so that a discharge port face provided with said ink discharge ports and the recording medium are out of contact and are separated by a predetermined gap.

25. An ink jet recording apparatus according to claim 19, wherein a continuous section located between said planar section of said platen and said slant section of said platen is opposed near a trailing end of the monochrome discharge port array in a conveyance direction of the recording medium, the monochrome discharge port array being formed of a plurality of ink discharge ports along the recording medium conveyance direction.

26. An ink jet recording apparatus according to claim 19, wherein a continuous portion located between said planar section of said platen and said slant section of said platen is opposed to an ink discharge port array for yellow ink located at a trailing end of the color discharge port array in a conveyance direction of the recording medium, the color discharge port array being formed of a plurality of ink discharge ports arranged along the recording medium conveyance direction.

27. An ink jet recording apparatus according to claim 19, further comprising recording medium exhausting means comprising a pair of rollers disposed on respective sides of a conveyance passageway through which the recording medium is conveyed, wherein a roller on a recording head side on the conveyance passageway is displaced toward the image area, as compared to a roller on a side of said platen on said conveyance passageway, to guide the recording medium.

28. An ink jet recording apparatus according to claim 19, further comprising recording medium exhausting means comprising a pair of rollers disposed on respective sides of a conveyance passageway through which the recording medium is conveyed, for guiding said recording medium at a position displaced 0.4 mm to 0.8 mm from an extension of the planar section of said platen toward said at least one slant portion.

29. An ink jet recording apparatus according to claim 19, further comprising recording medium conveying means for guiding and conveying the recording medium toward contact with said planar section of said platen, upstream of the image recording area in a recording medium conveyance direction.

30. An ink jet recording apparatus according to claim 29, further comprising recording medium exhausting means comprising a pair of rollers disposed on respective sides of a conveyance passageway through which the recording medium is conveyed, wherein a roller on a recording head side on the conveyance passageway is displaced toward the image area, as compared to a roller on a side of said platen on the conveyance passageway, to carry the recording medium therebetween.

31. An ink jet recording apparatus according to claim 20, wherein different ink jet recording heads held on said head holding member are provided with electrothermal converters and discharge the ink through ink discharge ports with the heat energy generated by said electrothermal converters.

32. An ink jet recording apparatus according to claim 19, wherein said slant section is arranged below an extension of the planar section for guiding the recording medium downward from the extension of the planar section to compensate for deformation of the recording medium by swelling and floating up off the platen surface with the ink sinking into the recording medium.

33. An ink jet recording apparatus according to claim 19, further comprising a pair of exhausting rollers for pinching the recording medium downward of the slant section and a position where said pair of exhausting rollers pinch the recording medium is located spaced apart from said head holding portion and downward of an extension of said planar section.

34. An ink jet recording apparatus having an image recording area which performs image recording onto a recording medium using an ink jet recording head for discharging ink through ink discharge ports, said apparatus comprising:

a head mounting portion capable of mounting either a color ink jet recording head having a color discharge port array on which discharge ports for discharging a predetermined number of different color inks are arranged in line, or a monochrome ink jet recording head having a monochrome discharge port array, shorter than said color discharge port array, and on which discharge ports for discharging ink having a monochrome color are arranged in line;

a platen having a planar section for supporting the recording medium opposed to the ink discharge ports in the image recording area, said planar section being opposed to said monochrome discharge port array when said monochrome ink jet recording head is mounted on said head mounting portion, and being opposed to said color discharge sort array when said color ink jet recording head is mounted on said head mounting portion, and a slant section disposed downstream of said planar section and inclined away from said ink discharge ports, said slant section not being opposed to said monochrome discharge port array when said monochrome ink jet recording head is mounted on said head mounting portion, and being opposed to said color discharge sort array when said color ink jet recording head is mounted on said head mounting portion; and a sheet exhausting portion at the downstream end of said platen for conveying the recording medium, said sheet exhausting portion being arranged below an extension of the planar section for carrying said recording medium downstream from the extension of the planar section to compensate for the deformation of the recording medium swelling and floating up the platen surface with the ink sinking into the recording medium.

35. An ink jet recording apparatus according to claim 34, wherein said planar section and said slant section are continuous, an angle made between an extension of said planar section and said slant section being from 3.7 degrees to 7.5 degrees.

36. An ink jet recording apparatus according to claim 34, wherein an end portion of said slant section downstream with respect to the conveyance direction of the recording medium guides the recording medium at a position 0.4 mm to 0.8 mm apart from the extension of said planar section of said platen.

37. An ink jet recording apparatus according to claim 34, wherein said planar section of said platen is opposed to the monochrome discharge port array, the monochrome discharge port array being comprised of 128 ink discharge ports.

38. An ink jet recording apparatus according to claim 34, wherein said planar section of said platen is substantially parallel to a discharge port face provided with said ink discharge ports.

39. An ink jet recording apparatus according to claim 34, wherein said planar section of said platen holds the recording medium so that a discharge port face provided with said ink discharge ports and the recording medium are out of contact and are separated by a predetermined gap.

40. An ink jet recording apparatus according to claim 34, wherein a continuous section located between said planar section of said platen and said slant section of said platen is opposed near a trailing end of the monochrome discharge port array in a conveyance direction of the recording medium, the monochrome discharge port array being formed of a plurality of ink discharge ports arranged along the recording medium conveyance direction.

41. An ink jet recording apparatus according to claim 34, wherein a continuous portion located between said planar section of said platen and said slant section of said platen is opposed to an ink discharge port array for yellow ink located at a trailing end of the color discharge port array in a conveyance direction of the recording medium, the color discharge port array being formed of a plurality of ink discharge ports arranged along the recording medium conveyance direction.

42. An ink jet recording apparatus according to claim 34, said exhausting portion comprising a pair of rollers disposed on respective sides of a conveyance passageway through which the recording medium is conveyed, wherein a roller on a recording head side on the conveyance passageway is displaced toward the image area, as compared to a roller on a side of said platen on said conveyance passageway, to guide the recording medium.

43. An ink jet recording apparatus according to claim 34, said exhausting section comprising a pair of rollers disposed on respective sides of a conveyance passageway through which the recording medium is conveyed, for guiding said recording medium at a position displaced 0.4 mm to 0.8 mm from an extension of the planar section of said platen toward said slant section.

44. An ink jet recording apparatus according to claim 34, further comprising recording medium conveying means for guiding and conveying the recording medium toward contact with said planar section of said platen, upstream of the image recording area in the recording medium conveyance direction.

45. An ink jet recording apparatus according to claim 44, said exhausting portion comprising a pair of rollers disposed on respective sides of a conveyance passageway through which the recording medium is conveyed, wherein a roller on a recording head side on the conveyance passageway is displaced toward the image recording area, as compared to a roller on a side of said platen on the conveyance passageway, to carry the recording medium therebetween.

46. An ink jet recording apparatus according to claim 34, wherein different ink jet recording heads held on said head holding member are provided with electrothermal converters and discharge the ink through ink discharge ports with the heat energy generated by said electrothermal converters.

47. An ink jet recording apparatus according to claim 34, wherein said slant section is arranged below the extension of the planar section for guiding the recording medium downward from the extension of the planar section to compensate for deformation of the recording medium.

48. An ink jet recording apparatus according to claim 34, wherein said sheet exhausting portion comprises a pair of exhausting rollers for pinching the recording medium downward of the slant section and a position where said pair of exhausting rollers pinch the recording medium is located spaced apart from said head holding portion and downward of the extension of said planar section.

49. A recording method for recording an image on a recording medium with a color ink jet recording head or a monochrome ink jet recording head mounted on a head mounting portion capable of mounting either the color ink jet recording head having a color discharge port array on which discharge ports for discharging a predetermined number of different color inks are arranged in line, or the monochrome ink jet recording head having a monochrome discharge port array shorter than the color discharge port array, and on which discharge ports for discharging ink having a monochrome color are arranged in line, said method comprising the steps of:

providing a platen having a planar section for supporting the recording medium opposed to the ink discharge ports in an image recording area and a slant section disposed downstream of the planar section and inclined away from the ink discharge ports; and selecting and mounting, on the head mounting portion, one of the color ink jet recording head having the color discharge port array opposed to the planar section and the slant section of the platen, and the monochrome ink jet recording head having the monochrome discharge port array shorter than the color discharge port array and being opposed to only the planar section of the platen.

* * * * *

UNITED STATES PATENT AND TRADEMARK OFFICE

CERTIFICATE OF CORRECTION

PATENT NO. : 6,092,892

DATED : July 25, 2000

INVENTOR(S) : TANIGURO ET AL.

It is certified that error appears in the above-identified patent and that said Letters Patent is hereby corrected as shown below:

COLUMN 8:

Line 18, "$P_2$ $P_2$" should read --$P_2$. $P_0$--.

COLUMN 16:

Line 38, "sort" should read --port--.

Line 46, "sort" should read --port--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*